United States Patent [19]

Garda et al.

[11] 4,215,819

[45] Aug. 5, 1980

[54] APPARATUS FOR EXPLOSIVE APPLICATION OF COATINGS TO ARTICLES

[76] Inventors: Alexandr P. Garda, ulitsa Yanvarskogo vosstania, 24a, kv. 54; Oleg A. Andruschak, ulitsa Semashko, 12, kv. 107; Alexei P. Epik, ulitsa Gorkogo, 9, kv. 19; Sergei A. Kozlov, ulitsa Korotchenko, 25a, kv. 29; Evgeny F. Grechishkin, ulitsa Chelyabinskaya, 9, kv. 131; Georgy A. Voronin, prospekt 40 Letia Oktyabrya, 94/2, kv. 44; Viktor N. Krendelev, ulitsa Orlovskaya, 19, kv. 1, all of Kiev, U.S.S.R.; Grigory V. Samsonov, deceased, late of Kiev, U.S.S.R.; Nadezhda A. Samsonov, administrator; Natalya G. Samsonov, administrator, both of Vladimirskaya ulitsa, 51/53, kv. 43, Kiev, U.S.S.R.; Evgeny G. Samsonova, adminstrator, Leninsky prospekt, 44, kv. 199, Moscow, U.S.S.R.

[21] Appl. No.: 862,339

[22] Filed: Dec. 20, 1977

[51] Int. Cl.[2] ..... B05B 1/24; B05B 17/00

[52] U.S. Cl. ..... 239/81; 137/112

[58] Field of Search ..... 239/79, 81, 85; 118/620; 427/12; 425/1; 264/121; 137/112

[56] References Cited

U.S. PATENT DOCUMENTS

| | | | |
|---|---|---|---|
| 2,774,625 | 12/1956 | Hawley et al. | 239/81 X |
| 2,869,924 | 1/1959 | McGill | 239/81 |
| 3,150,828 | 9/1964 | Pelton et al. | 239/79 |
| 3,773,259 | 11/1973 | Zverev | 239/81 |
| 4,004,735 | 1/1977 | Zverev et al. | 239/79 |

*Primary Examiner*—Andres Kashnikow

*Attorney, Agent, or Firm*—Lackenbach, Lilling & Siegel

[57] ABSTRACT

The invention relates to the application of powder coatings to vital components of equipment in various industries. The apparatus comprises a barrel for application of powder to the article and a gas distribution unit which connects fuel gas feeding passages and a purging gas feeding passage to the barrel. Gases are fed to outlet pipes of gas passages from appropriate gas sources under pressure through valves mounted in the pipes. The outlet opening of the purging gas passage may, in some embodiments be located upstream of the zone of admission of fuel gases to the barrel in the path of flow of purging gas. The pressure of the purging gas source exceeds the pressure of each of the fuel gas sources so that, upon feeding fuel gas to the barrel, the valves mounted at the outlet pipes of the fuel gas passages shut-off these pipes. After the valve mounted in the purging gas passage is closed, the valves mounted in the fuel pipes admit fuel gases to the barrel to build-up a detonation wave.

8 Claims, 4 Drawing Figures

APPARATUS FOR EXPLOSIVE APPLICATION OF COATINGS TO ARTICLES

FIELD OF THE INVENTION

The invention relates to apparatus for application of coatings to articles and, more specifically to apparatus for explosive application of coatings to articles.

The present invention may be most efficiently used for shot peening of articles, preparation of spherically-particled powders and application of coatings of pulverulent materials.

DESCRIPTION OF THE PRIOR ART

At present, apparatus for explosive application of coatings to articles are being widely used in various industries (mechanical engineering, turbine manufacture, tooling, manufacture of chemical equipment and the like). Coatings formed by this method enable the service life of vital parts of machines and mechanisms to be considerably prolonged. Apparatus for explosive application of coatings permit coatings of improved quality to be obtained (as regards better adherence of a coating to the article and a lower void ratio of the coating) with much lower heating of the article compared to the equipment for flame or plasma application of coatings.

Known in the art are apparatus for explosive application of coatings in which fuel and purging gases are fed from appropriate gas sources to a barrel through valves disposed in passages for feeding gases and controlled by means of mechanical or electric drives. Such apparatus have means for initiating an explosion in the barrel and feeding powder to the barrel, the powder being applied to the article through the barrel.

U.S. Pat. No. 2,714,563 (Aug. 2, 1955), discloses an apparatus in which preparation of an explosive mixture in a fuel gas mixing chamber and purging of the barrel with nitrogen are effected by means of three mechanically operated valves disposed in gas feeding passages and controlled by a cam-type distribution arrangement.

The disadvantages of this gas distribution system consist in the provision of three valves, the complicated drive thereof and the use of lubricants for the valves, thus imposing special safety requirements in operation with oxygen. GDR Pat. No. 98048, (published May 6, 1973) discloses an explosive spraying apparatus in which preparation of explosive mixture in the mixing chamber and purging of the barrel are effected by means of three electromagnetic valves operating in accordance with a pre-set program. In this apparatus, use is made of a sophisticated electronic control system generating control signals for controlling the three valves and the ignition of explosive mixture. Further a jet type gas mixer is very complicated to manufacture.

In an apparatus disclosed in U.S. Pat. No. 3,150,828, gases are admitted to the barrel through a mixing chamber by means of three mechanically operated valves controlled by a camshaft which is rotated by an electromechanical drive.

It is known that metal-to-metal friction contacts exist in mechanically operated valves which require the use of lubricants. Therefore, the construction of oxygen valves that comply with safety requirements is complicated.

Changes in the manufacturing conditions in the above-described apparatus require a complicated re-adjustment of the cam-type distribution mechanism (replacement of the cams and change of the rotational speed of the camshaft), and special safety requirements are imposed due to the presence of friction contacts and lubricants.

SUMMARY OF THE INVENTION

It is an object of the invention to simplify the construction of the apparatus for explosive application of coatings to articles.

Another object of the invention is to provide rapid re-adjustment of the apparatus for different manufacturing conditions.

Still another object of the invention is to provide the safety of operation of the apparatus.

And, finally, it is an object of the invention to simplify the maintenance of the apparatus for explosive application of coatings to articles.

These and other objects are accomplished by an apparatus for explosive application of coatings to articles comprising a barrel for feeding powder to an article, and a gas distribution unit for connecting said barrel to passages for feeding fuel gases to build-up a detonation wave in the barrel and to passages for feeding purging gases. These passages are connected, via valves, to respective sources of gases under pressure and to a chamber for mixing fuel gases. The apparatus is also provided with means for initiating an explosion in the barrel and for feeding the powder to said barrel. According to the invention, the chamber for mixing fuel gases is arranged at the entrance opening of the barrel. In some embodiments, the outlet opening of the passage for feeding purging gas is located upstream of the zone of admission of fuel gases to the barrel in the path of flow of the purging gas. The source of purging gas is adjusted to a pressure exceeding the pressure of each of the fuel gas sources; and, the valves of the passages for feeding fuel gases are arranged between the outlet openings of these passages and the mixing chamber, so as to admit fuel gases to the barrel when in the open position and to shut-off the fuel gas passages when in the closed position during the admission of purging gas to the barrel.

In one embodiment of the invention, outlet pipes of the fuel gas passages are arranged opposite one another. There is provided a passage connecting the purging gas passage to the fuel gas passages and incorporating said valves of the fuel gas passages. Each valve comprises a plate having overflow apertures in the peripheral portion thereof, the middle portion of the plate serving to shut off the outlet pipe of the fuel gas passage.

In another embodiment of the invention, the outlet pipes of said passages are incorporated in a gas distribution unit in such a manner that the outlet openings of the pipes are located within the fuel gas mixing chamber, the pipe for feeding purging gas projecting farther than the other pipes. The middle pipe has, at the projecting end thereof, a loosely mounted disc having a portion adapted to shut-off the outlet pipes of the fuel gas passages and overflow apertures made outside this portion.

In accordance with one embodiment of the invention, the outlet pipes of said fuel gas passages are arranged symmetrically at an angle with respect to the pipe for feeding purging gas. A guide member is provided at the center of the chamber for mixing gases, the guide member defining with the chamber walls a passage for feeding gases to the barrel. Each valve of the fuel gas passages comprises a plate which is mounted at the outlet pipe of the fuel gas passage to shut it off and has overflow apertures in the peripheral portion of the plate.

Another embodiment of the invention involves the outlet pipes of said passages being incorporated in said gas distribution unit, the pipe for feeding purging gas being arranged between the other outlet pipes and connected thereto by means of a transverse passage which incorporates the valves of said fuel gas passages. These valves comprise ball valves shutting-off the fuel gas passages in one position during the admission of purging gas to the barrel.

The apparatus according to the invention is much simpler in structure compared to the prior art equipment. Thus the maintenance of the apparatus is considerably facilitated, and the safety of operation is improved due to the absence of metal-to-metal friction contacts and because of the elimination of the need for lubrication.

BRIEF DESCRIPTION OF THE DRAWINGS

Other objects and advantages of the invention will become apparent from the following detailed description of specific embodiments thereof with reference to the accompanying drawings, in which.

DETAILED DESCRIPTION OF THE INVENTION

Figure 1:
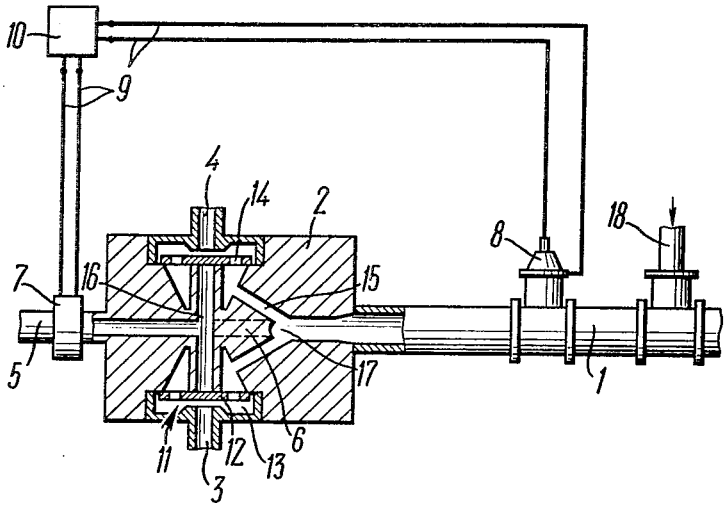
FIG. 1 is a longitudinal view, partially broken away, of the apparatus for explosive application of coatings to articles according to the invention.

The apparatus comprises a barrel 1 (FIG. 1) through which powder is applied to an article (not shown). Explosive mixture is prepared in a gas distribution unit 2 which connects the barrel 1 to outlet pipes 3 and 4 of passages for feeding fuel gases—acetylene and oxygen—as well as to an outlet pipe 5 of a passage for feeding purging gas—nitrogen. Gases are fed to the barrel 1 from appropriate sources of gases under pressure (not shown). Pressure of the purging gas source is much higher than the pressure of each fuel gas source. For changing the energy parameters of the explosion, the unit 2 has a passage 6 for feeding a diluent gas for dilution of the explosive mixture. Nitrogen or argon may be used as the diluent gas.

Purging gas is fed to the pipe 5 through an electromagnetic valve 7. The barrel 1 incorporates means for initiating an explosion, such as spark plugs 8. The valve 7 and the spark plugs 8 are connected by means of conductors 9 to a programmed control unit 10.

Fuel gases from appropriate gas sources are fed through valves 11 mounted in the pipes 3 and 4 in the unit 2.

Each valve 11 comprises a flat disc 12 loosely mounted in a chamber 13. The disc 12 has apertures 14 made at a radial distance exceeding the radial distance from the outlet openings of the pipes 3 and 4. The chambers 13 communicate with the barrel 1 through passages 15. The pipe 5 communicates with the chambers 13 through a passage 16.

All passages for feeding gases to the barrel 1 communicate with one another in a fuel gas mixing chamber 17 arranged at the entrance opening of the barrel 1.

The apparatus has a means 18 for feeding powder to the barrel 1 (not shown).

The apparatus functions in the following manner.

Prior to the beginning of the operation, an article (or articles) to be coated is placed in front of the barrel 1. Oxygen and acetylene in quantities needed for given manufacturing specifications are fed to the pipes 3 and 4. The fuel gases urge the discs 12 against the end faces of the passage 16 and are admitted, through the apertures 14 of the discs and the passages 15, via the chamber 17, to the barrel 1. Two signals—one for opening the valve 7 and the other for initiation of an explosion by means of the spark plugs 8—are generated in the control unit 10 in accordance with a pre-set program.

After initiation of the explosion, a detonation wave expells the powder from the barrel 1 onto the article. Upon opening of the valve 7, nitrogen is fed, via the pipe 5, to the passage 16 and, due to the higher pressure in the pipe 5, urges the discs 12 to shut-off the pipes 3 and 4, thereby permitting the flow of nitrogen from the chambers 13, via the passages 15, to the barrel 1. The valve 7 is closed after the explosion products are removed from the barrel 1. The discs 12 are urged against the end faces of the passage 16 by flows of oxygen and acetylene, and the fuel gases are again admitted to the barrel 1 to form an explosive mixture for the next explosion.

A diluent gas is added to the explosive mixture through the passage 6 if the energy parameters of the explosion need to be changed.

Figure 2:
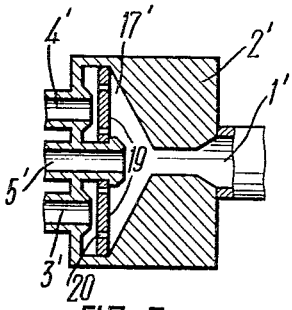
FIGS. 2–4 show cross-sectional views of various embodiments of the gas distribution unit of the apparatus according to the invention.
Figure 3:
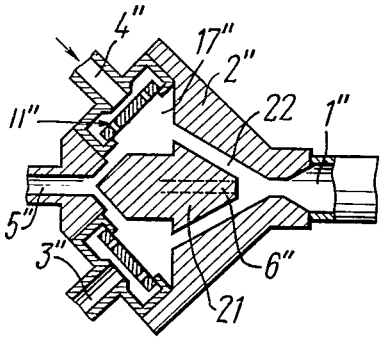
Figure 4:
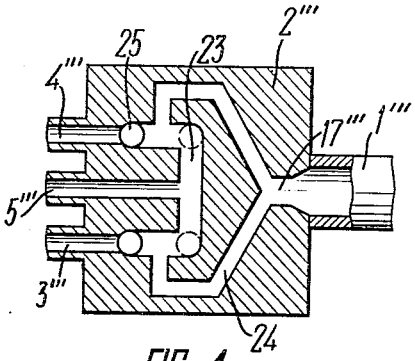

FIGS. 2–4 show various embodiments of the gas distribution unit 2.

The pipes 3', 4' and 5' for feeding gases may terminate in the chamber 17' of the distribution unit 2' (FIG. 2). The pipe 5' projects farther than the other pipes 3' and 4' into the chamber 17'. A disc 19 having apertures 20 is loosely mounted on the projecting portion of the pipe 5'.

Upon feeding purging gas to the pipe 5', the disc 19 is urged against the pipes 3' and 4' to shut them off under the action of gauge pressure in the chamber 17'. After the valve 7 is closed, fuel gases are fed to the pipes 3' and 4' to urge the disc 19 away, and, after passing through the apertures 20, to flow into the chamber 17' and, from there, into the barrel 1'.

FIG. 3 shows a gas distribution unit 2'' in which the pipes 3'' and 4'' are arranged symmetrically at an angle with respect to the middle pipe 5''. A guide member 21 is mounted at the center of the chamber 17'' to define with the wall of the chamber 17'' a passage 22 for admission of gases to the barrel 1''.

In this embodiment of the apparatus, the construction of the valve 11'' is similar to that of the valves 11 shown in FIG. 1.

The gas distribution unit 2''' shown in FIG. 4 comprises pipes 3''', 4''' and 5''' for feeding gases communicating with one another and with the barrel 1''' through a transverse passage 23 and a passage 24. Ball valves 25 are incorporated in the pipes 3''' and 4'''.

Upon feeding purging gas to the pipe 5''', the balls 25 of the valves shut the pipes 3''' and 4''' and purging gas is fed through the passage 24 to the gas mixing chamber 17''' and from there, to the barrel 1'''. After the valve 7 is closed, fuel gases urge the balls 25 to the passage 23, and flow into the barrel 1''' through the passage 24.

To modify the rate of application of coating to an article, the control unit is set to an appropriate performance. The use of the apparatus according to the invention for application of coatings to compressor and turbine vanes for aircraft engines enables the total service life of the engine to be increased by several times so that the cost of repair of each engine is considerably lowered. Application of coatings to tape recording heads also prolongs their service life. Application of coatings to rolls provides for a considerable of decrease in the number of repair periods of rolling mills with considerable savings. The use of hard metal coatings for tools enables the saving of expensive hard metals along with considerable simplification of the manufacturing process.

What is claimed is:

1. An apparatus for explosive application of powder coatings to an article comprising: a barrel through which said powder is fed to said article; sources of purging gas and fuel gases under pressure having outlet pipes for feeding said gases to said barrel, the pressure of said purging gas source exceeding the pressure of each of said fuel gas sources; a gas distribution unit having a fuel gas mixing chamber arranged in an entrance opening of said barrel and connecting said outlet pipes to said barrel, outlet openings of said fuel gas outlet pipes being arranged opposite one another in said gas distribution unit, a passage in said gas distribution unit connecting an outlet opening of said purging gas outlet pipe to said outlet openings of said fuel gas outlet pipes; and valve means incorporated in said passage and being mounted between the outlet openings of said fuel gas outlet pipes and said mixing chamber, said valve means admitting said fuel gases to said barrel when in the open position and shutting off the flow of said fuel gases when in the closed position during the admission of purging gas to said barrel, each valve means comprising a plate having overflow apertures in a peripheral portion and a middle portion for closing the outlet opening of a respective fuel gas outlet pipe.

2. An apparatus according to claim 1, wherein the pressure of the flow of said purging gas urges said valve means into said closed position.

3. An apparatus for explosive application of powder coatings to an article comprising: a barrel through which said powder is fed to said article; sources of purging gas and fuel gas under pressure having outlet pipes for feeding said gases to said barrel, the pressure of said purging gas source exceeding the pressure of each of said fuel gas sources; a gas distribution unit having a fuel gas mixing chamber arranged in an entrance opening of said barrel and connecting said outlet pipes to said barrel, outlet openings of said outlet pipes being located within the gas mixing chamber, said outlet opening of said purging gas outlet pipe projecting further into the mixing chamber then said outlet openings of said fuel gas outlet pipes; and a valve means including a disc loosely mounted on a distal end of said purging gas outlet pipe, a portion for closing said outlet openings of said fuel gas outlet pipes, and overflow apertures made on peripheral portions of said disc, said valve means admitting said fuel gases to said barrel when in the open position and shutting off the flow of said fuel gases when in the closed position during the admission of purging gas to said barrel.

4. An apparatus according to claim 3, wherein the pressure of the flow of said purging gas urges said valve means into said closed position.

5. An apparatus for explosive application of powder coatings to an article comprising: a barrel through which said powder is fed to said article; sources of purging gas and fuel gases under pressure having outlet pipes for feeding said gases to said barrel, the pressure of said purging gas source exceeding the pressure of each of said fuel gas sources; a gas distribution unit having a fuel gas mixing chamber arranged in an entrance opening of said barrel and connecting said outlet pipes to said barrel, outlet openings of said fuel gas outlet pipes being arranged within said gas distribution unit symmetrically at an angle with respect to an outlet opening of said purging gas outlet pipe; a guide member provided within said gas mixing chamber and defining with walls of said mixing chamber a passage for admission of gases to said barrel; and valve means mounted between said outlet openings of said fuel gas outlet pipes and said mixing chamber, said valve means admitting said fuel gases to said barrel when in the open position and shutting off the flow of said fuel gases when in the closed position during admission of purging gas to said barrel, each of said valve means comprising a plate mounted in close proximity to said outlet opening of a respective fuel gas outlet pipe, said plate having a portion for closing said outlet opening of said respective fuel gas outlet pipe and overflow apertures in a peripheral portion thereof.

6. An apparatus according to claim 5, wherein the pressure of the flow of said purging gas urges said valve means into said closed position.

7. An apparatus for explosive application of powder coatings to an article comprising: a barrel through which said powder is fed to said article; sources of purging gas and fuel gases under pressure having outlet pipes for feeding said gases to said barrel, the pressure of said purging gas source exceeding the pressure of each of said fuel gas sources; a gas distribution unit having a fuel gas mixing chamber arranged in an entrance opening of said barrel and connecting said outlet pipes to said barrel, outlet openings of said outlet pipes being positioned within said gas distribution unit, said outlet opening of said purging gas outlet pipe being arranged between said outlet openings of said fuel gas pipes, a transverse passage connecting said outlet of said purging gas outlet pipe to said outlet openings of said fuel gas outlet pipes; and valve means incorporated in said transverse passage and being mounted between said outlet openings of said fuel gas outlet pipes and in said mixing chamber; said valve means admitting said fuel gases to said barrel when in the open position and shutting off the flow of said fuel gases when in the closed position during the admission of purging gas to said barrel, each of said valve means comprising ball valve means closing the outlet openings of said fuel gas outlet pipes in one position of the valve means during the admission of purging gas to the barrel.

8. An apparatus according to claim 7, wherein the pressure of the flow of said purging gas urges said valve means into said closed position.

* * * * *